United States Patent [19]

Moore

[11] 4,308,826

[45] Jan. 5, 1982

[54] SHELL BOILERS

[75] Inventor: John P. Moore, Gainsborough, England

[73] Assignee: Vosper Thornycroft (UK) Limited, England

[21] Appl. No.: 960,128

[22] Filed: Nov. 13, 1978

[51] Int. Cl.[3] ..... F22B 1/02

[52] U.S. Cl. ..... 122/4 D; 165/104.16

[58] Field of Search ..... 122/140, 153, 195, 4 D; 110/263, 245; 431/170, 7; 165/104 F

[56] References Cited

U.S. PATENT DOCUMENTS

| | | | |
|---|---|---|---|
| 2,652,814 | 9/1953 | Vedder | 122/169 |
| 2,664,346 | 12/1953 | Mayhew | 122/4 D |
| 2,931,711 | 4/1960 | Walker | 122/4 D |
| 2,997,286 | 8/1961 | Friese | 122/4 D X |
| 3,387,590 | 6/1968 | Bishop | 122/4 D |
| 3,589,342 | 6/1971 | Barker et al. | 122/4 D |
| 3,890,935 | 6/1975 | Moss et al. | 122/4 D |
| 3,910,235 | 10/1975 | Highley | 122/4 D |

*Primary Examiner*—Edward G. Favors

*Attorney, Agent, or Firm*—Prutzman, Kalb, Chilton & Alix

[57] ABSTRACT

A shell boiler containing boiler water or other fluid to be heated, including a furnace providing a fluidized bed and disposed inside or outside the boiler. Heat transfer pipes extend through the fluidized bed and are connected for natural circulation with the boiler fluid. In a preferred embodiment, the furnace is constituted by a furnace section of the boiler and the heat transfer pipes extend vertically through the bed and through the furnace section and are provided throughout the entire length of the furnace section.

10 Claims, 21 Drawing Figures

FIG.18.
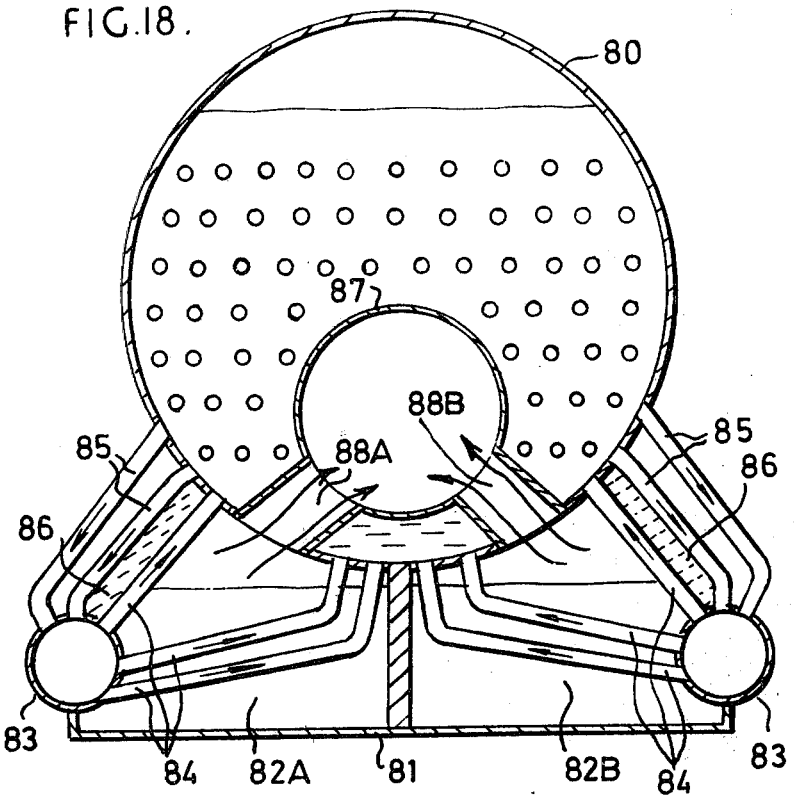
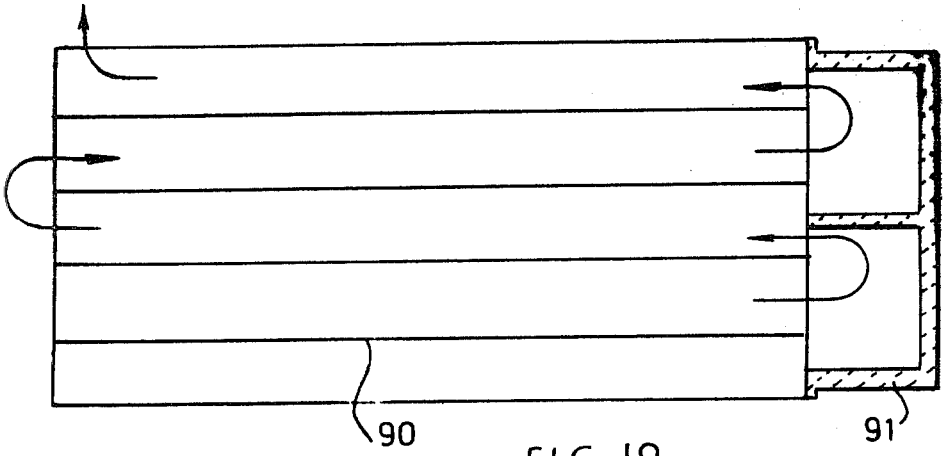
FIG. 19

SHELL BOILERS

BACKGROUND OF THE INVENTION

This invention relates to shell boilers, that is to say to a boiler having a shell containing water or a fluid, such as thermal fluid, to be heated; such a shell boiler normally has a furnace section in the form of a horizontal cylindrical tunnel extending through the boiler and in which combustion takes place. It is also usual to provide flue tubes extending horizontally through the water or fluid and to which the products of combustion are directed and which serve to heat the water further. The boiler may be used, for example, for generating steam or heating water or thermal fluid (oil).

British Patent Specification No. 1,426,579 shows a shell boiler containing water or other fluid to be heated with a removable furnace section providing a fluidised bed. Water or other fluid passes through tubing in the fluidised bed but is separate from the working fluid circuit.

It is an object of this invention to provide an improved shell boiler.

SUMMARY OF THE INVENTION

According to this invention, a shell boiler containing water or fluid to be heated includes a furnace providing a fluidised bed and disposed inside or outside the boiler. Heat transfer pipes extend through the fluidised bed and are connected for natural circulation with the boiler water or fluid.

Preferably, the furnace is constituted by at least one furnace section of the boiler and the heat transfer pipes extend vertically through the bed and through the furnace section and are provided throughout the entire length of the furnace section.

Preferred embodiments of this invention will now be described, by way of example only.

DESCRIPTION OF THE DRAWINGS

FIG. 18 is an end view of yet another boiler in accordance with this invention;

FIGS. 19 and 20 are general views explaining the operation of the shell boilers in accordance with this invention showing different arrangements for the transfer of flue gases from furnace sections into flue tubes.

Figure 1:
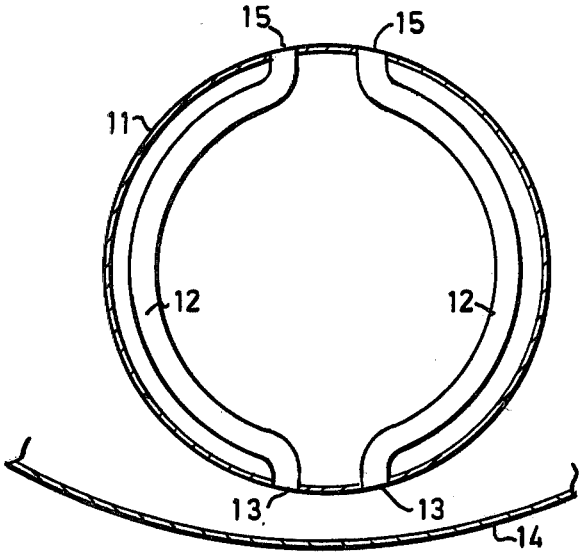
FIG. 1 is an end view of part of one shell boiler according to the present invention with a circular furnace within the shell fully water cooled.

Referring first to FIG. 1, this shows diagrammatically an end view of the cylindrical furnace section 11 of a shell boiler. Throughout the length of the furnace section 11, there are provided heat transfer pipes 12 on both sides of the cylindrical furnace having inlets 13 for receiving cooler water contained between the section 11 and the exterior shell 14 near the bottom of the boilers. After heating in the heat pipes 12 in the furnace section 11 the water and stream flow by density change through outlets 15 back into the main water volume contained in the shell. The pipes 12 are provided throughout the length of the furnace section and can be semicircular in outline so as to be adjacent to the wall of the furnace section 11. For the sake of clarity, a fluidised bed which in use is present at the bottom of the furnace section 11 and through which the heat transfer pipes 12 extend is not shown in FIG. 1.

Figure 2:
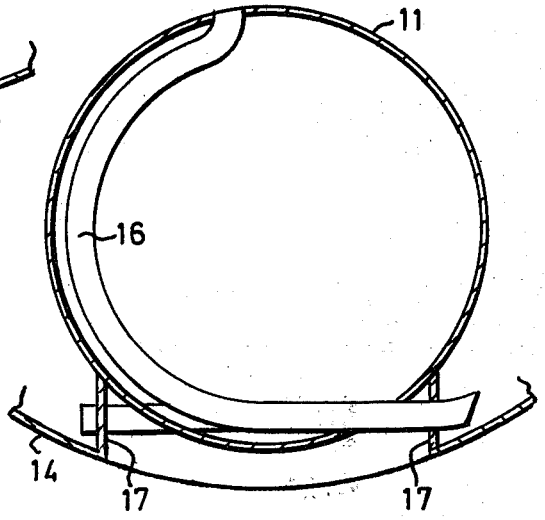
FIGS. 2 and 3 show alternative forms of the boiler shown in FIG. 1, the water cooled circular furnace having an opening through the boiler shell along its entire length.

FIG. 2 shows a modification in which the furnace section is open at the bottom, the lower ends of the heat transfer pipes 16 being connected to tube plates 17 alternately on each side.

Figure 3:
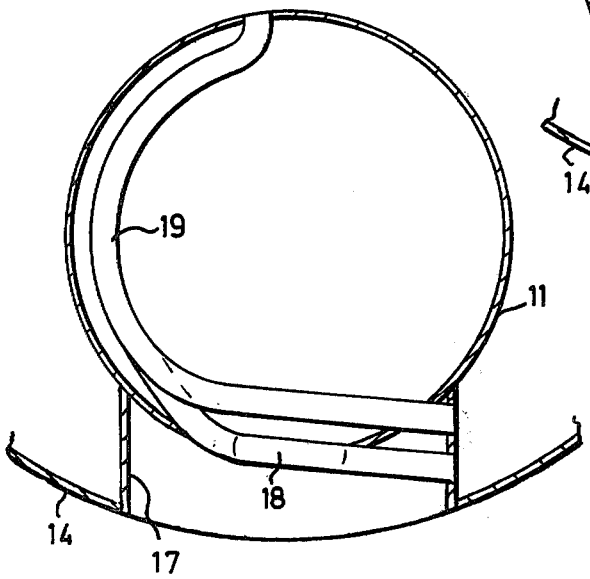
Figure 4:
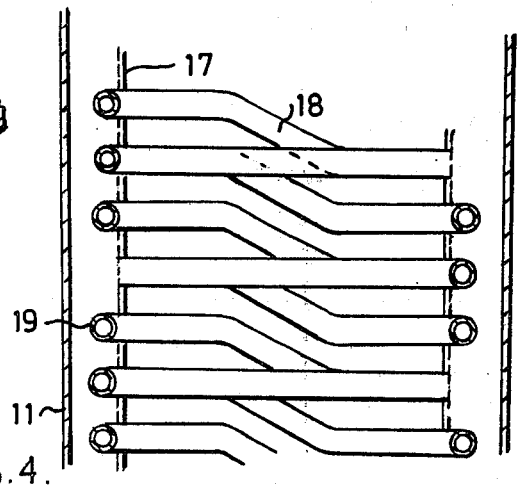
FIG. 4 is a plan view of part of FIG. 3.

FIGS. 3 and 4 shows a further modification in which lower end portions 18 of heat transfer pipes 19 are angled to increase the heating surface presented to the fluid bed.

Figure 5:
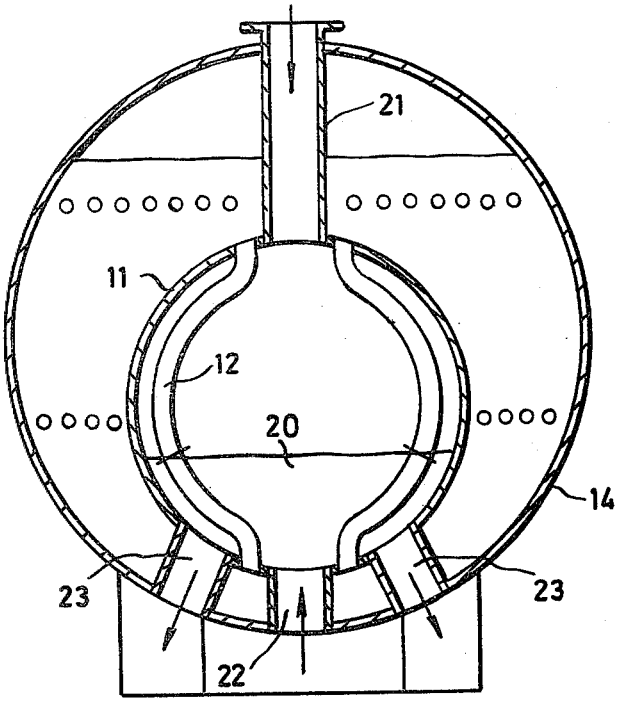
FIG. 5 is an end view of another alternative shell boiler including a variation of the water cooled furnace of FIG. 1.

FIG. 5 shows a still further modification in which a fluidised bed 20 is shown in the furnace section 11. The bed is fed with coal via vertical tubes 21 above the bed 20, air is introduced via bottom inlets 22, and ash is withdrawn via tubes 23.

If desired the shell boiler may be of extending length and provided with two or more parallel furnace sections to obtain high steam outputs, say in excess of 100,000 lbs. per hour.

One advantage of the boilers described above is that they may be designed to be capable of firing oil or gas in place of the fluidised bed and the design techniques and calculations employed for fluid bed, oil, or gas firing can be based upon the well-known and well-established geometry for conventional shell boilers.

Figure 6:
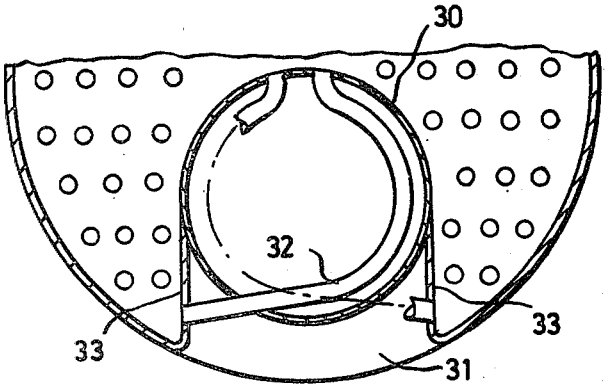
FIG. 6 is a partial end view of another boiler in accordance with this invention including an open furnace as shown in FIGS. 3 and 3.
Figure 7:
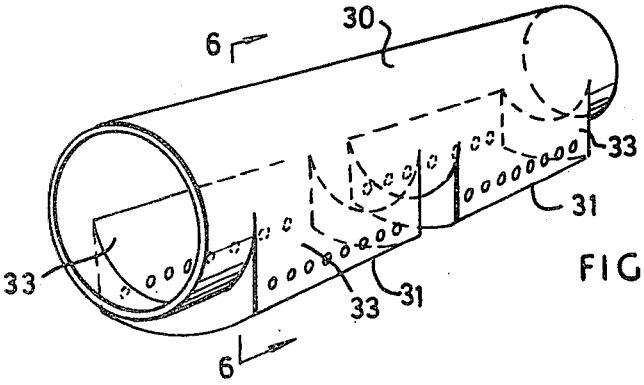
FIG. 7 is a perspective view of the furnace section of the boiler shown in FIG. 6, FIG. 6 being taken in the direction of the arrows 6—6 of FIG. 7.

Another shell boiler is shown in FIGS. 6 and 7 and is provided with a furnace section 30 having two openings 31 of rectangular cross-section which extend through the bottom of the boiler. A plurality of heat pipes 32 are provided in the furnace section and are connected at their lower ends alternately to the side plates 33 of the openings 31. Any desired number of openings 31 may be provided, for instance even five or six, depending on the overall size of the boiler and on its duty. This arrangement permits a plurality of independent fluid beds (not shown) to be provided, thus facilitating turndown ratios for boiler output to be obtained.

Figure 8:
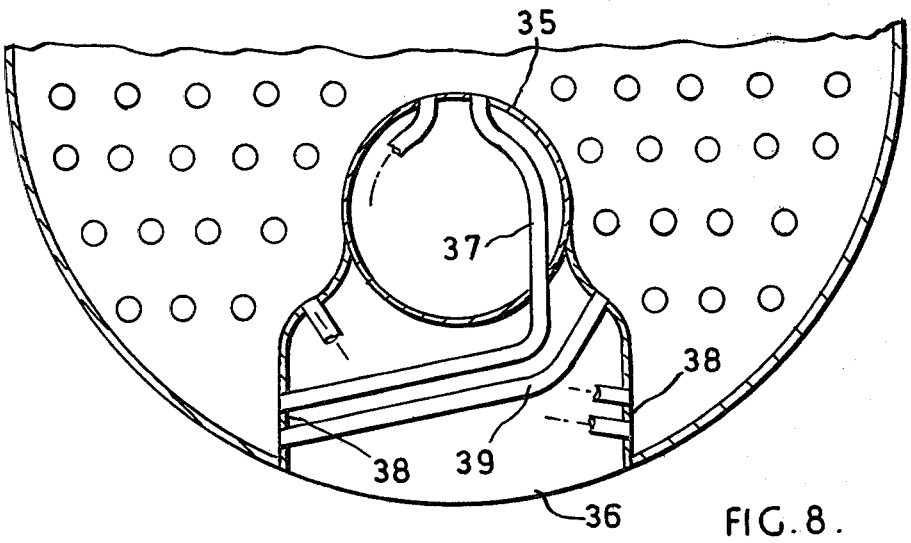
FIG. 8 is a partial end view of another boiler in accordance with this invention.

FIG. 8 shows a modification of the boiler of FIGS. 6 and 7, the fluidised bed again not being shown for the sake of clarity. In this shell boiler, a furnace section 35 is arranged higher up in the boiler and is provided with one or more openings 36 of lateral width larger than the diameter of the furnace section. A first set of heat transfer pipes 37 are connected between the top of the furnace section 35 and alternate side plates 38 of the opening or openings. A second set of heat transfer pipes 39 are connected at their respective ends to upper and lower points of the side plates 38. This arrangement can be used to provide an increase in the heat transfer area per unit length of the boiler and allows a deeper fluidised bed to be used.

Figure 9:
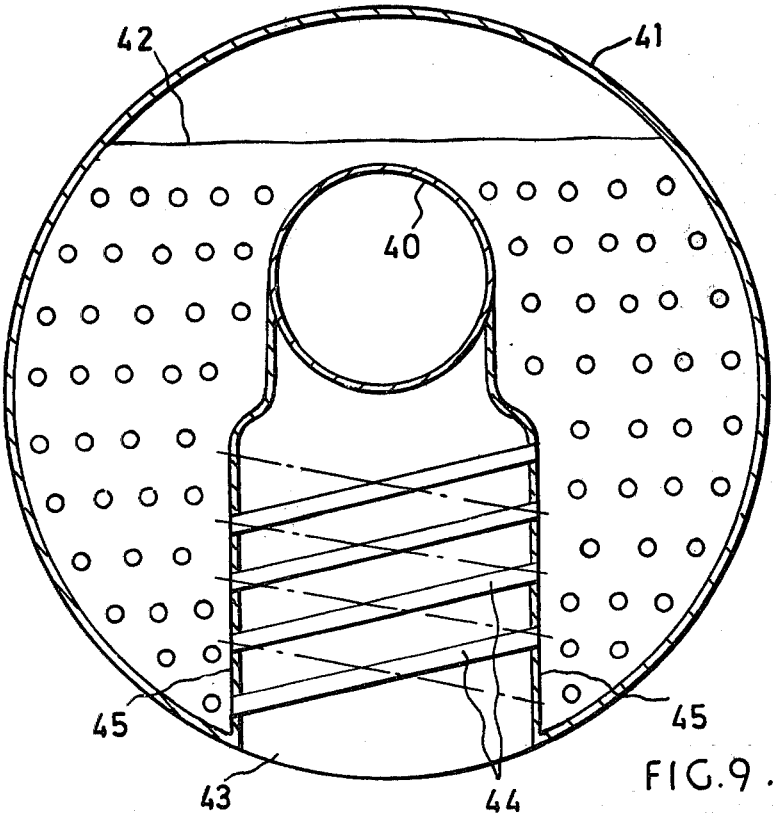
FIG. 9 is a partial end view of another boiler in accordance with this invention.

FIG. 9 shows a shell boiler in which a furnace section 40 has been arranged at the highest practical level in the shell 41, the normal working level of water being indicated at 42. The furnace section 40 extends through at least one opening 43 of rectangular horizontal cross-section to the bottom of the boiler. A plurality of heat transfer tube 44 are provided in the opening 43 connected at their ends to opposite side plates 45 of the opening. Four rows of heat transfer pipes 44 are shown in the drawing with the higher ends directed to alternate side plates 45. This arrangement allows the use of a very deep fluidised bed (not shown) and may be used when small area deep beds are desirable. The four rows of heat transfer pipes provide substantial additional heating surface.

Figure 10:
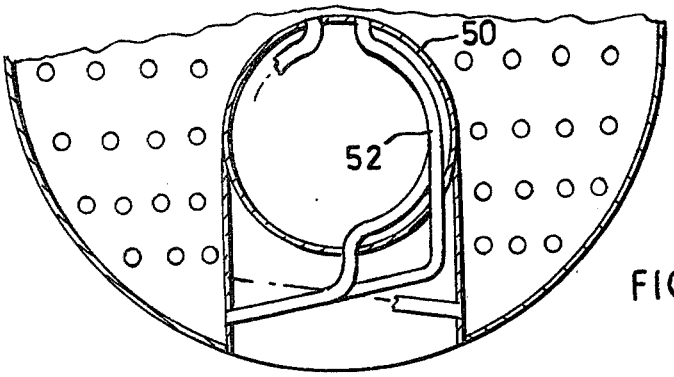
FIG. 10 is a partial end view of another boiler in accordance with this invention being taken along the lines 10—10 of FIG. 11.
Figure 11:
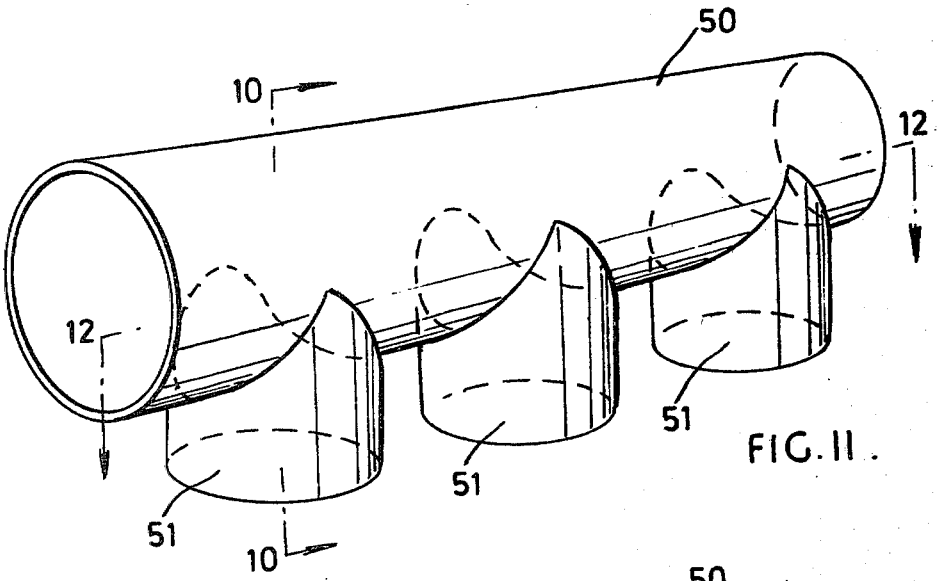
FIG. 11 is a perspective view of a furnace section only of the boiler of FIG. 10.
Figure 12:
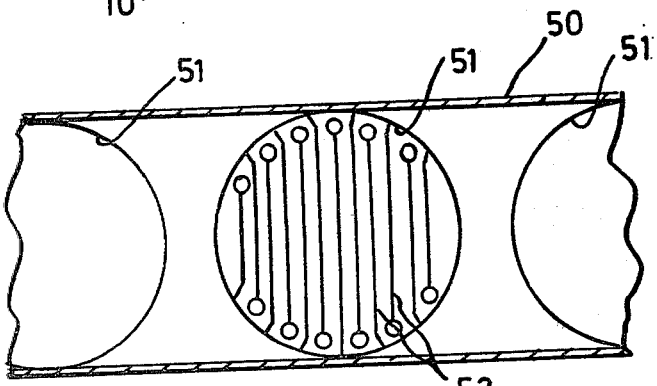
FIG. 12 is a partial plan view in the direction of the arrows 12—12 of FIG. 11.

The shell boiler shown in FIGS. 10, 11 and 12, is provided with a furnace section 50 extending via a plurality of opening 51 of circular horizontal cross-section through the bottom of the boiler shell. A plurality of heat-pipes 52 is provided, the pipes being connected between the top of the furnace section 50 and alternate sides of the openings 51. This arrangement also allows the use of deep fluidised beds and can be used to allow a larger number of independent fluidised beds to be accommodated per unit of boiler length. This arrangement may be used when relatively high boiler working pressures are involved.

In each of the embodiments shown in FIGS. 6 to 12, the fluidised beds may, if necessary, be replaced by oil or gas firing.

Figure 13:
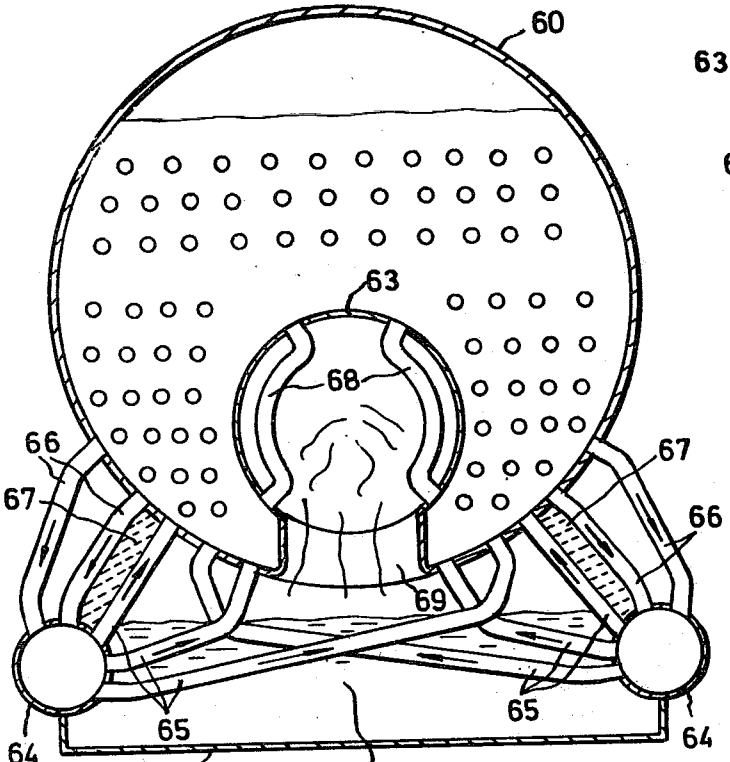
FIG. 13 is an end view of another boiler in accordance with this invention.

FIG. 13 shows another embodiment of a shell boiler 60 provided with an external furnace arrangement 61 providing a fluidised bed 62. The boiler 60 also has a conventional furnace section 63 and this may be used to allow oil or gas firing. Two water headers 64 are provided along respective sides of the furnace 61 and are connected to the boiler shell 60 via a plurality of heat transfer pipes 64 which extend through the fluidised beds 62. The water headers 64 are further connected to the boiler via water tubes 66, which are separated from the heat transfer pipes by means of refractory seals 67. The arrows indicate the direction of circulation of water through the heat pipes 65 and to the tubes 66. Secondary heat transfer pipes 68 are provided in the furnace section 63 and allow transfer of heat from hot gases rising from the bed 62 into the furnace section through circular openings 69 and passing therealong to convection banks. Whether the secondary heat transfer pipes are provided depends in part on the ratio of gas volume to a furnace diameter and such pipes may be useful at high pressures where relatively small furnace diameters may be necessary.

An advantage of the arrangement of FIG. 13 is that a relatively large fluidised bed area and heat transfer pipe area per unit boiler length can be obtained together with relatively large evaporation rates for a given boiler length. Further, this arrangement of boiler is relatively easy to design and construct for high working pressures.

Figure 14:
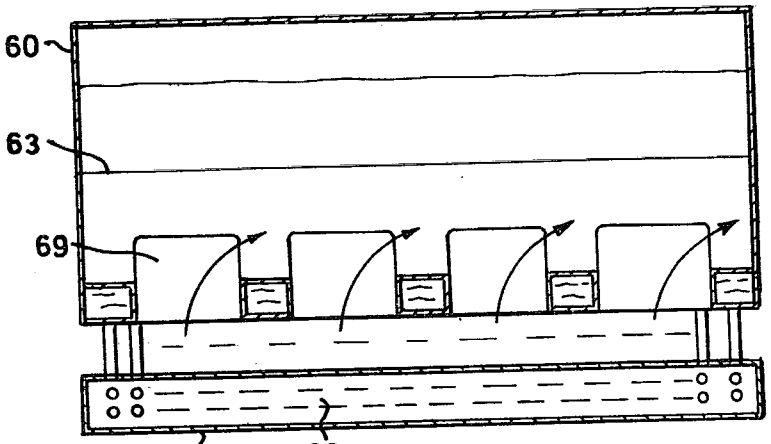
FIG. 14 is a side view of the boiler shown in FIG. 13.
Figure 15:
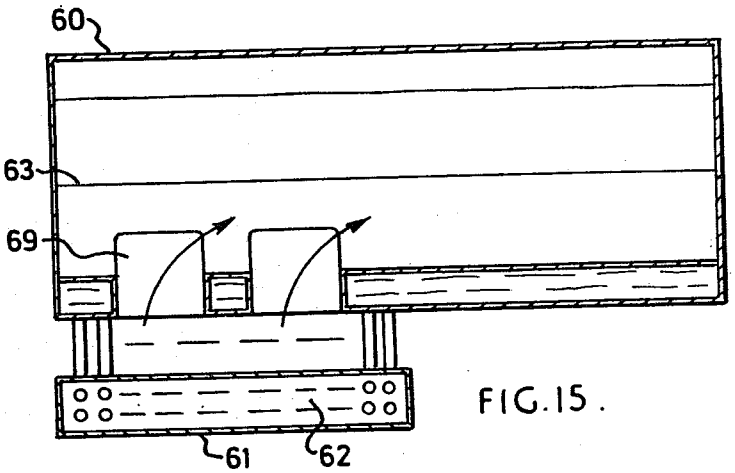
FIG. 15 is a side view of a modification of the boilers shown in FIGS. 13 and 14.

FIGS. 14 and 15 show two alternative embodiments employing the arrangement of FIG. 13. In FIG. 14, the furnace 61 and fluidised bed 62 extend along the whole length of the boiler 60, whereas the furnace and fluidised bed in FIG. 15 extends along approximately half the length of the boiler. In some cases, a fluidised bed which is shorter than the length of the boiler may be used because the heat transfer area per unit length is substantially increased by the increase in effective width.

Figure 16:
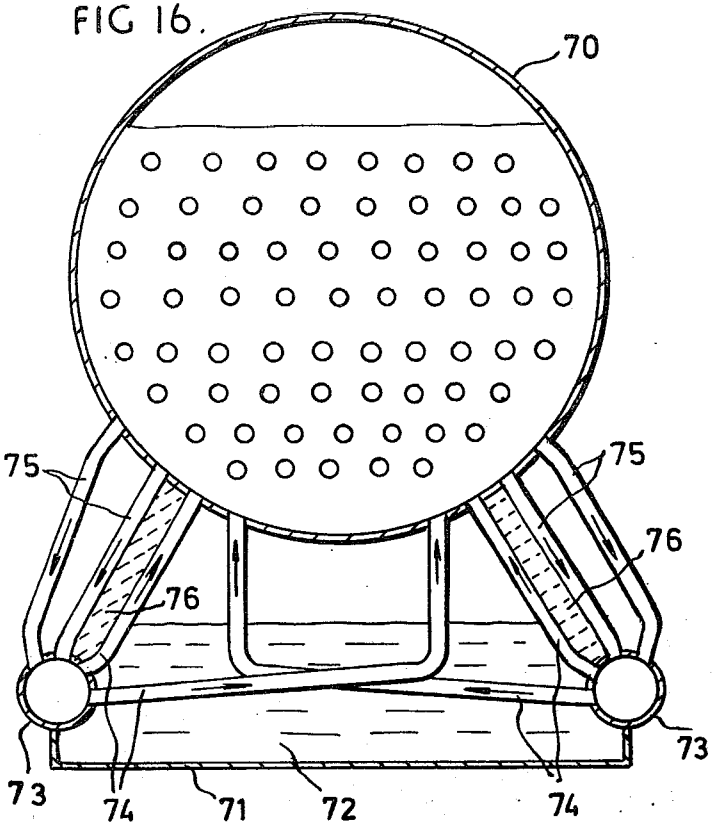
FIG. 16 is an end view of another boiler in accordance with this invention.

The arrangement shown in FIG. 16 comprises a shell boiler 70 and an external furnace arrangement 71 and fluidised bed 72. Two water headers 73 are provided at respective sides of the furnace and an arrangement of heat transfer tubes 74 and water tubes 75 similar to that shown in FIG. 13 is provided, together with refractory seals 76. In this embodiment, no furnace section is provided in the boiler 70. Again, the arrows indicate the normal circulation of water in the pipes 74 and the tubes 75.

This arrangement may be used in waste heat applications where the "top up fuel" is coal. The boiler could not normally be fired by conventional oil or gas burners although it would be possible to burn gas or oil in the fluid bed. The hot gases from the bed pass underneath the boiler shell to a convection path entry on the rear tube plate.

Figure 17:
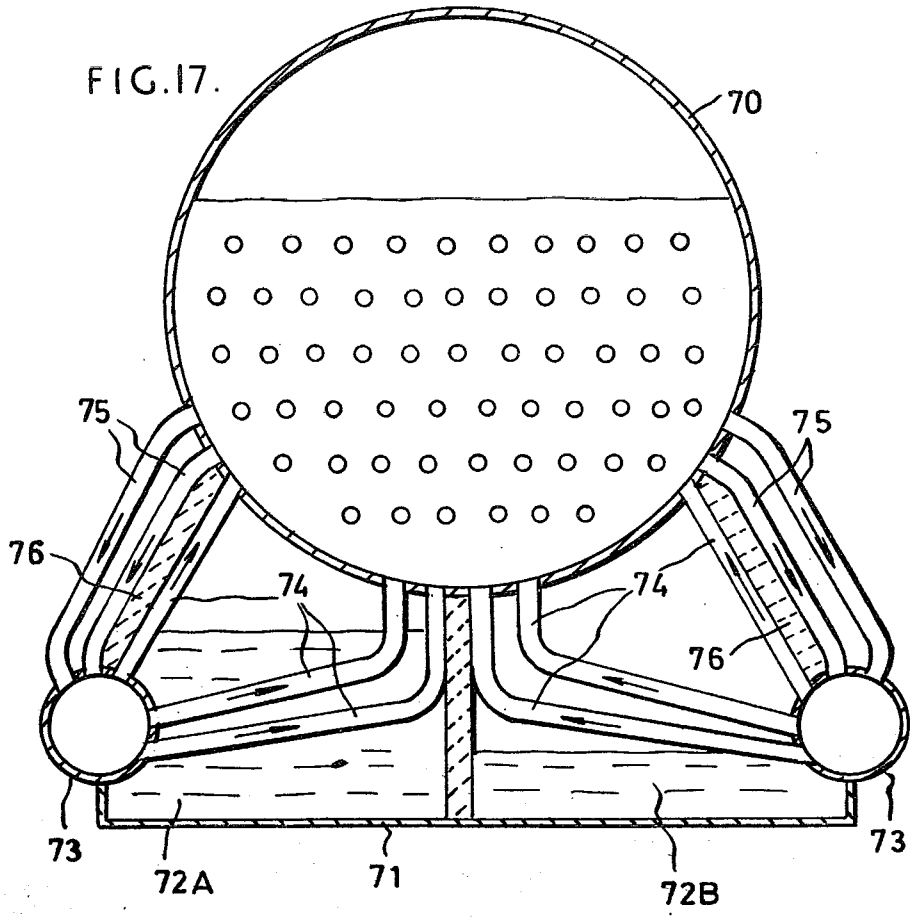
FIG. 17 is an end view of a modification of the boiler of FIG. 16 in accordance with this invention.

FIG. 17 shows a modification of the arrangement shown in FIG. 16. Like reference numerals referred to like parts in FIGS. 16 and 17. In this arrangement, the furnace 71 is divided into two halves to provide two independent fluidised beds 72A and 72B. The bed 72A is shown while firing in the drawing whereas the bed 72B is shown slumped, the two beds being operable entirely independently of each other. This arrangement provides for a greater turndown ratio.

FIG. 18 shows another embodiment of shell boiler 80 having a longitudinally divided external furnace arrangement 81 providing two independent fluidised beds 82A and 82B. The arrangement of heat transfer tubes 84, water headers 83, water tubes 85 and refractory seals 86 are similar to the arrangement shown in FIG. 16. However, the boiler 80 is provided with a furnace section 87 which communicates via openings 88A and 88B with the fluidised beds 82A and 82B, respectively. This arrangement allows conventional oil or gas firing to be used.

Figure 20:
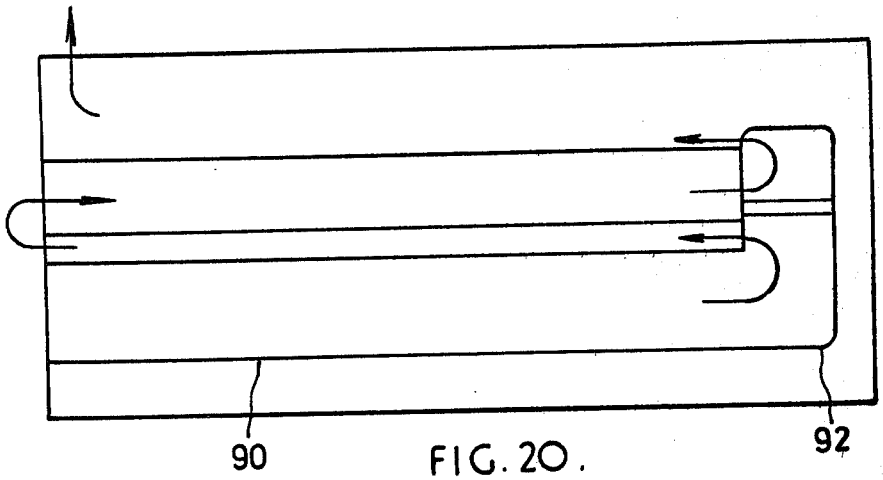

FIGS. 19 and 20, in which like reference numerals refer to like parts, show diagrammatically two preferred shell boilers having different arrangements for transfer of gases from the furnace section of the flue tubes. FIG. 19 shows a "dry back" boiler in which a furnace section 90 communicates with a first set of convection tubes via parts of a refractory lined chamber 91 at one end of the boiler. The first set of tubes communicates with a second set of tubes at the other end of the boiler and the second set of tubes communicates with a third set of tubes via another part of the refractory lined chamber 91.

FIG. 20 shows a "wet back" boiler in which the refractory lined chamber 91 of FIG. 19 is replaced by a submerged chamber 92 within the boiler at one end thereof.

Figure 21:
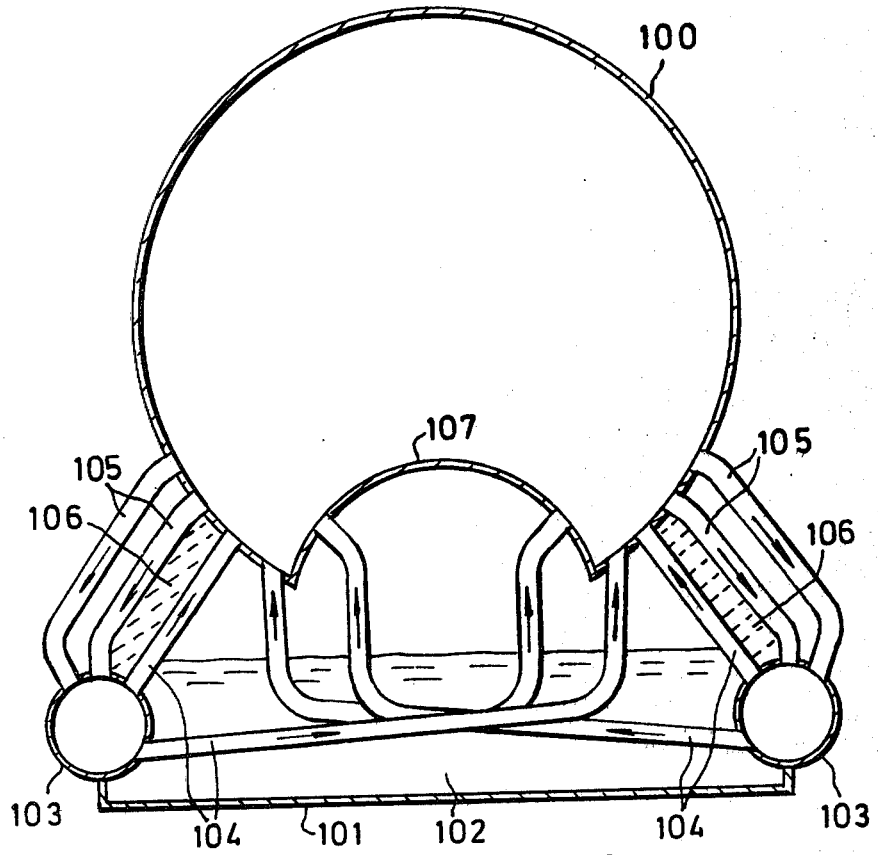
FIG. 21 is an end view of another boiler according to the invention.

The embodiment shown in FIG. 21 comprises a shell boiler 100 and an external furnace arrangement 101 and fluidised bed 102. Two water headers 103 are provided at respective sides of the furnace 101 and communicate with the boiler 100 via heat transfer pipes 104 and water tubes 105. The water tubes 105 are separated from the heat transfer pipes 104 by refractory seals 106.

A part-furnace section 107 in the form of a part cylindrical recess along the bottom of the boiler is provided and some of the heat transfer pipes 104 are connected to the boiler along the wall of this recess. This arrangement thus represents a design which is mid-way between the arrangement of FIG. 13, in which a furnace section is provided, and the arrangement of FIG. 16, in which on furnace section is provided. The arrangement of FIG. 21 has the advantage that this is not as expensive as that of FIG. 13 but would allow a conventional oil or gas burner to be fired along the underside of the boiler above the level of the fluidised bed 102.

What is claimed is:

1. A horizontal shell boiler comprising a shell, a horizontal passage extending through the shell, a space between the shell and the passage containing boiler fluid, at least one opening extending downwardly from the passage to the bottom of the shell forming a furnace section with the passage for housing a fluidized bed therein, and heat transfer pipes extending vertically through the furnace section for extending through and above the fluidized bed, the heat transfer pipes being provided throughout the length of the furnace section and being connected to the space between the shell and the passage for natural circulation of the boiler fluid therethrough.

2. A boiler as claimed in claim 1, in which the lower end of each heat transfer pipe extends across the bed and is angled so as to increase the heat transfer area thereof.

3. A boiler as claimed in claim 1, in which bottom inlets are provided through the boiler for the passage of air to the bed.

4. A boiler as claimed in claim 1, in which vertical tubes are provided through the top of the boiler for the supply of coal to the bed.

5. A boiler as claimed in claim 1, in which there is one opening extending throughout the entire length of the boiler.

6. A boiler as claimed in claim 1, in which said opening is of rectangular horizontal cross-section.

7. A boiler as claimed in claim 1, in which said opening is of circular horizontal cross-section.

8. A boiler as claimed in claim 5, in which the heat transfer pipes are connected at their lower ends to the shell at the sides of said opening.

9. A boiler as claimed in claim 1, in which the upper ends of the heat transfer pipes are connected to the shell at the top of the furnace section.

10. A boiler as claimed in claim 8, in which at least some of the heat transfer pipes are connected at their upper ends to respective opposite sides of said opening.

* * * * *